United States Patent [19]

Christensen

[11] 4,126,108

[45] Nov. 21, 1978

[54] APPARATUS FOR DRAINING A COOLING SYSTEM

[76] Inventor: Fredrich M. Christensen, 10256 Prarie Rd., Omaha, Nebr. 68134

[21] Appl. No.: 826,145

[22] Filed: Aug. 19, 1977

Related U.S. Application Data

[63] Continuation-in-part of Ser. No. 764,708, Feb. 1, 1977, abandoned.

[51] Int. Cl.[2] ..... F01P 11/20

[52] U.S. Cl. ..... 123/41.14; 137/62

[58] Field of Search ..... 123/41.14; 137/59, 60, 137/61, 62; 180/82 R, 103 R; 105/59

[56] References Cited

U.S. PATENT DOCUMENTS

| | | | |
|---|---|---|---|
| 1,786,878 | 12/1930 | Van Keuren | 137/62 |
| 1,924,250 | 8/1933 | McGuire | 137/60 |
| 1,924,251 | 8/1933 | McGuire | 137/62 |
| 2,032,670 | 3/1936 | Simmen | 123/41.14 |
| 2,408,183 | 9/1946 | Wood | 123/41.14 |
| 2,597,061 | 5/1952 | Burich | 123/41.14 |
| 2,688,460 | 9/1954 | Borgerd | 137/62 |
| 3,621,907 | 11/1971 | Ephraim | 123/41.14 |
| 3,648,715 | 3/1972 | Boothe | 137/62 |

FOREIGN PATENT DOCUMENTS

| | | | |
|---|---|---|---|
| 931,043 | 7/1973 | Canada | 137/62 |
| 565,096 | 11/1932 | Fed. Rep. of Germany | 123/41.14 |

*Primary Examiner*—Ronald H. Lazarus
*Assistant Examiner*—Jeffrey L. Yates
*Attorney, Agent, or Firm*—Robert A. Ostmann

[57] ABSTRACT

The disclosure concerns apparatus for draining coolant from the liquid cooling system of a locomotive. The apparatus includes an automatic control which is armed upon shut-down of the engine and drains the cooling system upon the occurrence of freezing temperature conditions. The apparatus must be reset manually, and this requires two distinct manipulations, one of which effects override of the automatic control. Such override action is limited in duration to prevent inadvertent, prolonged disabling of the automatic control. The drain valve is a pilot operated, rotary plug valve. Preferably, the apparatus includes provisions for manually draining the cooling system, for effecting automatic draining by the combined effects of gravity and compressed air, and for providing visual indications of its operating state. Moreover, as far as practical, it is desirable to package the components in a unitary assembly which can be replaced easily and bench serviced and tested.

27 Claims, 5 Drawing Figures

RADIATORS
WATER TANK
OIL COOLER
ENGINE
CAB HEATERS
AIR COMPRESSOR
SUMP
COMP. AIR SYS.
AIR TEMP SWITCH
NO VOLT. RELAY

APPARATUS FOR DRAINING A COOLING SYSTEM

CROSS-REFERENCE TO RELATED APPLICATION

This application is a continuation-in-part of application Ser. No. 764,708, now abandoned filed Feb. 1, 1977.

BACKGROUND OF THE INVENTION

Commonly, a railroad locomotive in a consist travels between stations unattended. If the engine of such a locomotive should, for any reason, shut down, the heat in the cooling system will dissipate rapidly. In cases where the train is traveling at high speed and ambient temperature is well below zero, the coolant will freeze very quickly, and the engine and/or components of the cooling system can be severely damaged. Because of this possibility, it has been proposed to equip locomotives with apparatus for automatically draining coolant from the cooling system under conditions which may cause freeze-ups. One kind of apparatus which has been employed comprises a poppet type valve which is arranged to drain coolant from the lowest region of the system and whose movable head is spring biased against its seat. The head is unseated either by a solenoid, or by a piston to which compressed air is selectively delivered by a separate solenoid valve. In either case, the solenoid is energized by an electrical circuit which includes a contact of the No Voltage Relay (NVR) and a temperature responsive switch. While this kind of apparatus theoretically solves the problem of preventing freezing of the coolant, from the practical standpoint it has proven deficient. Two of the most serious difficulties which I have encountered are leakage at the seat of the drain valve, and corrosion of the head-carrying stem which prevents full opening as well as re-seating of the head. In addition, since the apparatus automatically re-sets, i.e., closes the drain valve, when the temperature rises above the freezing level, or the electrical circuit is disabled, an empty cooling system can be refilled inadvertently at times when this is imprudent. Finally, since the apparatus has no provision for effecting manual draining, additional equipment must be provided for that purpose.

Another known type of automatic drain apparatus employs a drain plug which is released by a pressure surge in the coolant produced by an explosive squib. The squib is detonated automatically by an electrical circuit in response to the occurrence of freezing conditions. In my experience, this kind of drain device is not satisfactory, first, because misfiring is not uncommon, and second, because it cannot be reset, but must be removed from the locomotive and returned to the manufacturer for recharging after each use. Furthermore, the device obviously is not suitable for manual draining operations.

SUMMARY OF THE INVENTION

The object of this invention is to provide an improved apparatus for draining locomotive cooling systems which eliminates the disadvantages of the prior proposals mentioned above and affords other desirable features. The new apparatus employs a drain valve of the rotary plug type, particularly of the ball type, which is moved to open position by motor means, but must be manually reset (i.e., closed). The motor means is selectively energized by automatic control means which includes at least one temperature sensor and which is rendered effective by arming means which responds to the operating state of the locomotive engine. The arrangement is such that the automatic control means energizes the motor means, and effects opening of the drain valve, only when the engine is shut down and the sensed temperature is below a predetermined low value indicative of freezing conditions. The apparatus also includes manually triggered reset means which serves to override the automatic control means so as to de-energize the motor means for a limited period of time, and a manually operable valve actuator through which the drain valve may be closed during the limited override period and may be opened at any time.

The drain valve used in the improved apparatus is free of the leakage and corrosion problems which were encountered with the prior poppet type valves, and consequently is more reliable. Moreover, since the drain valve must be closed manually, and this operation requires two distinct manual manipulations, the apparatus tends to insure that refilling of an empty system will be a deliberate step, and, consequently, minimizes the occurrence of inadvertent and imprudent filling. The timed nature of the reset override action is important because it insures that the automatic control cannot be disabled through carelessness for dangerously long periods of time. In addition, since the drain valve may be opened manually, the invention facilitates shop-servicing of locomotives without the need for auxiliary drain equipment and at times when the automatic control means is disabled, as, for example, when its source of motive energy has been disconnected.

In its preferred form, the improved drain apparatus affords additional advantages, among which are:

1. The inclusion of pressurizing means for delivering compressed air to the cooling system during automatic drain action. This measure expedites the draining process, insures complete emptying of the cooling system, and tends to expel from the system sediment which might collect in the region of the drain valve.

2. The incorporation in said pressurizing means of a special air supply circuit which is charged from the conventional locomotive air system, but furnishes compressed air to the drain apparatus after the locomotive system is depleted.

3. The use of an automatic control which includes both a coolant temperature sensor and an ambient air temperature sensor. This feature not only insures that a hot engine will not be drained too quickly, but also prevents unnecessary draining of the cooling system.

4. The provision of visual indicators which display to the crew the armed and draining status, respectively, of the apparatus.

5. The incorporation of most of the components in a single, easily removable unit or assembly. This feature makes possible bench servicing and testing of the major parts, and thus permits maintenance of the drain apparatus without the necessity of keeping the locomotive out of service.

BRIEF DESCRIPTION OF THE DRAWINGS

Several embodiments of the invention are described herein in detail with reference to the accompanying drawings, which contain schematic illustrations, and in which.

DESCRIPTION OF THE ILLUSTRATED EMBODIMENTS

Figure 1:
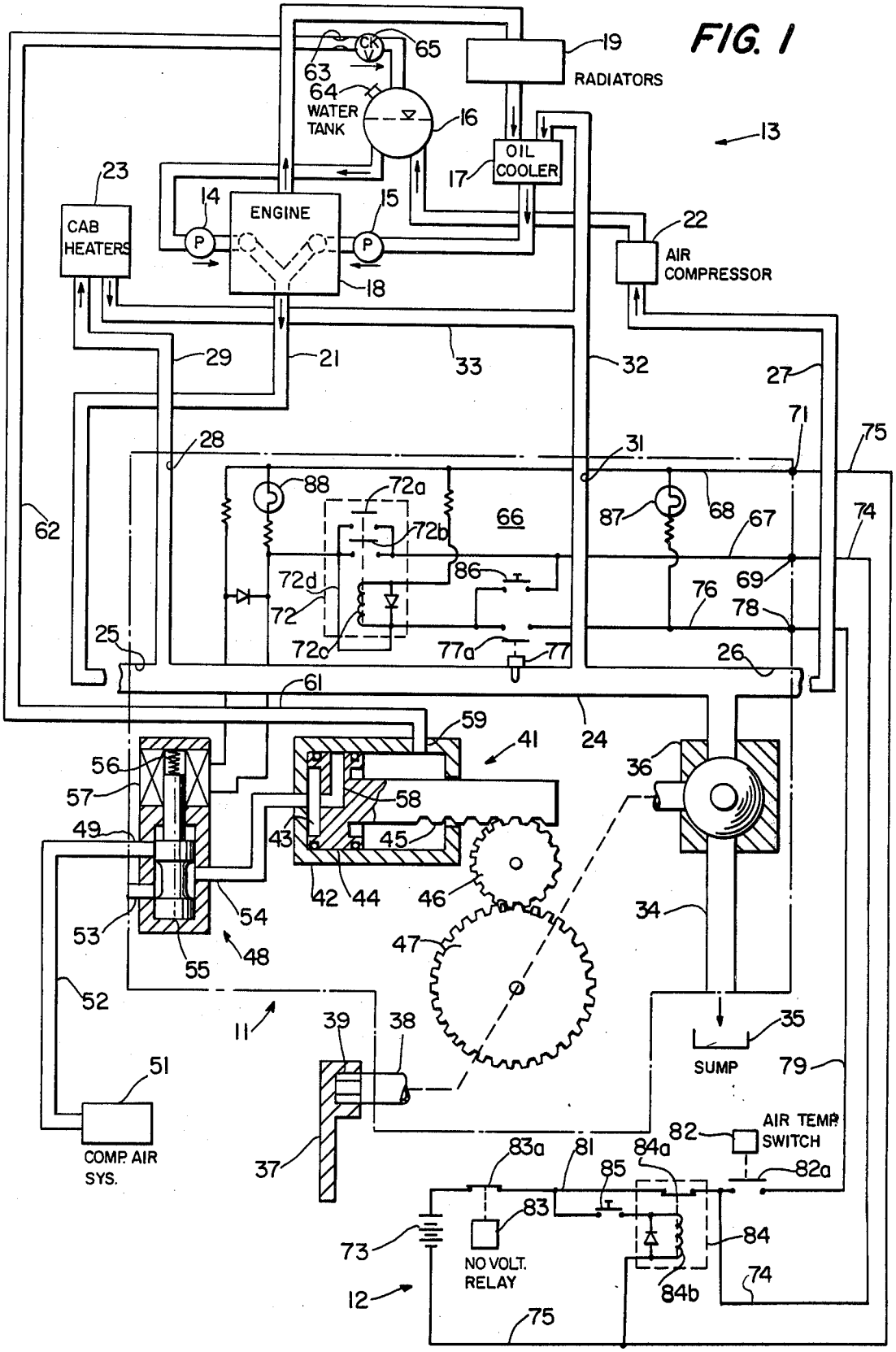
FIG. 1 is a diagram showing the drain apparatus in association with a simplified version of the typical cooling system used on an EMD locomotive.

As shown in FIG. 1, the improved drain apparatus comprises a unitary drain valve assembly 11 and an external electrical circuit 12 and is associated with a typical EMD locomotive cooling system 13. That system comprises a pair of engine-driven pumps 14 and 15 which draw coolant from water expansion tank 16 and lubricating oil cooler 17, respectively, and deliver it to the engine 18. The heated water which leaves the engine is passed through the radiators 19, where it is cooled, and is then returned to oil cooler 17 to be recycled. A portion of the output of pumps 14 and 15 is diverted to a pipe 21 and is used to cool locomotive air compressor 22 and, when needed, to supply heat to locomotive cab heaters 23. The water discharged from the air compressor jacket is recycled through expansion tank 16, and the discharge from cab heaters 23 is recycled through oil cooler 17. Drain valve assembly 11 contains ports and passages which duplicate the normal piping scheme of the cooling system so as to complete the flow paths to compressor 22 and cab heaters 23.

Drain valve assembly 11 comprises a housing, indicated by phantom lines, containing a horizontal manifold passage 24 which is provided with a pair of end ports 25 and 26 through which it is connected, respectively, with pipe 21 and with a pipe 27 which leads to the cooling jacket of compressor 22, and a side port 28 to which the supply pipe 29 of cab heaters 23 is connected. A smaller additional side port 31 connects with the normal drain tube 32 which depends from return pipe 33 of the cab heaters. Although not illustrated, it will be understood that ports 25, 26, 28 and 31 are tapped, and that the cab heater pipes contain the usual shut-off valves. Manifold passage 24 is at a lower elevation than any of the other parts of cooling system 13 and is intersected by a vertical, depending drain passage 34 which opens into the locomotive sump 35 and contains a ball type shut-off valve 36. A suitable shut-off valve is the 1½" Model No. VEA2-A7 Dynaquip ball valve.

Shut-off valve 36 has two actuators, the first of which comprises a manually operated handle 37 which is located outside the housing and is coupled with the exposed end of the ball shaft 38. The coupling 39 between these parts preferably is of the quick disconnect type, and may consist simply of a shaft end of polygonal cross section and a mating handle socket. This kind of coupling is desirable because it permits handle 37 to be removed easily when it is not needed, and thus tends to minimize the risk that the handle will strike a crewman when valve 36 is actuated by the automatic control. In order to guard against loss, it is recommended that handle 37 be held captive on assembly 11, as by a length of chain (not shown). Handle 37 may be used to either open or close valve 36, but it is effective to close the valve only when the second valve actuator (described below) is deenergized.

The second actuator for shut-off valve 36 comprises a single-acting fluid pressure motor 41 which includes a stationary cylinder 42 containing a working space 43, and a reciprocable piston 44. The linear motion of piston 44 is converted into the rotary motion required to operate valve 36 by a gear train comprising a rack 45 formed on the piston rod, an idler gear 46, and a drive gear 47 which is fixed to shaft 38. The gear ratio of this drive connection is so selected that full stroke movement of piston 44 rotates the ball of valve 36 through an angle of 90°, which, of course, is the angular displacement between its fully open and fully closed positions. Actuating motor 41 is controlled by a solenoid operated pilot valve 48, which may be the Model 302-12 Cartridge Valve marketed by Ambac Industries, Inc. Pilot valve 48 has a supply passage 49 which leads outside the housing of assembly 11 and is connected with the locomotive compressed air system 51 by a conduit 52, an atmospheric vent passage 53, and a service passage 54 which leads to the working space 43 of motor 41. Service passage 54 is selectively connected with one or the other of passages 49 and 53 by a reciprocable valve spool 55. This spool is biased by spring 56 to the illustrated vent position, in which passage 54 is connected with vent passage 53 and is isolated from supply passage 49, and is shifted by solenoid 57 to the supply position, in which service passage 54 is isolated from passage 53 and is connected with passage 49. The effective area of motor piston 44 is so correlated with the pressure of the air supplied to working space 43 that motor 41 cannot be overriden, and valve 36 closed, by manual actuation of handle 37 when the working space is pressurized. A motor force on the order of 550 pounds is considered adequate for this purpose.

As mentioned earlier, the preferred drain apparatus incorporates means for pressurizing cooling system 13 during automatic draining operations. The illustrated equipment for performing this function comprises a supply valve which is associated with actuating motor 41 and includes a passage 58 formed in motor piston 44 and which leads from working space 43 to the periphery of the piston, and a port 59 which is formed in cylinder 42 and is positioned to register with passage 58 when piston 44 has moved full stroke, and thus has opened drain valve 36. Port 59 is connected with the air space in expansion tank 16 via an internal passage 61 in assembly 11 and an external conduit 62. Since the illustrated apparatus uses the locomotive air system 51 as the source of compressed air, it is desirable to limit the amount of compressed air employed in effecting pressurized draining of the cooling system. Although there are various ways in which such a limitation can be imposed, the preferred manner consists simply of using a flow control orifice 63 in the delivery path to the cooling system. The orifice is sized to limit air flow to a rate which is effective to produce the desired rapid draining action, yet does not impose a significant drain on the locomotive air system. An acceptable flow rate is about 20 cubic feet per minute (CFM), considering that the air compressor 22 has an output capacity on the order of 200 CFM. The pressure level in locomotive air system 51 is much higher than that for which cooling system 13 is designed, so a pressure-reducing device must be provided. In cases where the filling cap 64 of water tank 16 is of the pressure relief type, that device itself satisfies the need. Otherwise, an auxiliary relief or reducing device must be installed. Since cooling system 13 sometimes is overfilled, it is considered prudent to provide at the tank end of conduit 62 a check valve 65 which is oriented to block reverse flow from tank 16 into the air delivery circuit.

The solenoid 57 of pilot valve 48 is controlled jointly by the external circuit 12 and an internal circuit 66. The internal circuit comprises a pair of leads 67 and 68 forming a power loop which interconnects terminals or connector pins 69 and 71, respectively, and which contains the solenoid and the parallel connected, normally open contacts **72*a* and 72*b* of relay 72. Terminals 69 and 71, in turn, are connected with opposite sides of locomotive battery 73 by leads 74 and 75 of external circuit 12. The coil 72*c* of relay 72 is connected in a control loop of internal circuit 66 which comprises lead 68 and a lead 76, and which contains the normally open contact 77*a* of a temperature switch 77. This switch 77 is arranged to sense the temperature of the coolant within manifold passage 24 and is set to close contact 77*a*** when that temperature is slightly above the freezing point. A setting of about 34° F. is suitable.

Lead 76 of internal circuit 66 is joined to the positive side of locomotive battery 73 through terminal 78 and the leads 79 and 81 of external circuit 12. This path contains the normally open contact **82*a* of an ambient air temperature switch 82, and the normally closed contact 83*a* of the No Voltage Relay (NVR) 83 normally provided on the locomotive. Air temperature switch 82 is set to close contact 82*a* at a temperature below the setting of coolant temperature switch 77, and preferably is set for 32° F. The NVR 83, as usual, responds to the output of the auxiliary generator which is driven by engine 18. Therefore, this device is responsive to the operating state of the engine and serves to open contact 83*a* only when the engine is running. Other engine shut-down sensors, such as a governor oil pressure switch, could be used in place of NVR 83**, but the illustrated arrangement is preferred because it requires no additional components.

In addition to the contacts **82*a* and 83*a*, the path connecting internal circuit lead 76 with battery 73 contains the normally closed contact 84*a* of the time delay relay 84, which forms part of a manually operable reset mechanism. Coil 84*b* of relay 84 is connected with locomotive battery 73 by a circuit containing a manually operated switch 85 of the momentarily closed type. As explained later, the reset mechanism normally must be used during filling of cooling system 13; therefore, it is desirable to locate switch 85 adjacent the filler cap 64 of water tank 16. Relay 84 acts to hold contact 84*a* open for a predetermined limited time period following energization, and the relay preferably is of the type which allows adjustment of the length of that period. A suggested holding period is 15 minutes, inasmuch as this normally provides sufficient time to complete refilling of the cooling system and starting of the engine. If these tasks are not completed within the holding period, the automatic controls will again be enabled to reopen drain valve 36**. Thus, this apparatus guards against inadvertent freeze-ups resulting from careless use of the manual reset mechanism to accomplish re-filling of the cooling system at an inappropriate time. In other words, the limited duration of the reset action precludes permanent or prolonged disabling of the automatic control.

It may be observed that NVR contact **83*a* and reset relay contact 84*a* also control the connection between lead 74 and battery 73**. The purposes of this arrangement are explained later.

Internal circuit 66 of assembly 11 incorporates some additional features which deserve notice. One of these is the provision of a manually operated switch 86 which is connected between leads 67 and 76 and provides an energization path for the coil **72*c* of relay 72 which is in parallel with the path containing the contacts 77*a* and 82*a* of the two temperature switches. This switch 86, which preferably is of the momentarily closed type, may be used to effect manual draining of cooling system 13 any time compressed air system 51 is charged, battery 73 is in place and is active, and engine 18 is shut down. Another desirable feature of circuit 66 concerns the inclusion of green and red pilot lamps 87 and 88, respectively, which display to the crew the operating state of the drain apparatus. Lamp 87 is connected between leads 68 and 76 and is lighted whenever contacts 82*a* and 83*a* are closed. Therefore, this lamp indicates that the apparatus is armed, i.e., ready to effect draining upon the occurrence of a dangerously low coolant temperature. Lamp 88, on the other hand, is connected across solenoid 57 and is lighted when the solenoid is energized. As a result, this lamp indicates that drain valve 36 has been opened (either by way of manually operated switch 86 or the automatic controls) and that the cooling system is draining or has been drained. Finally, circuit 66 includes a lead 72*d* connected to form a holding circuit which prevents deenergization of relay coil 72*c* as long as power is being delivered to valve solenoid 57. This feature prevents the severe arcing at contacts 72*a* and 72*b* which would occur if relay 72** were deenergized before the power circuit was opened.

It seems appropriate to remark here that the diodes shown in the drawings perform arc-suppressing functions and are included to protect the contacts of the various switches. Resistances are illustrated merely to show that the 64-volt output of locomotive battery 73 may have to be reduced if the electrical components are rated for lower voltages, as they normally would be. It also should be noted that solenoid 57 preferably is energized indirectly through relay contacts because its operating current may, in many cases, exceed the ratings of the small contacts used in commercially available temperature switches 77 and 82. Moreover, since solenoid 57 may be energized for relatively long periods of time, it must be rated for continuous duty.

When the illustrated apparatus is in service and engine 18 is running, contact **83*a* of NVR 83 and contact 77*a* of water temperature switch 77 will be open. Consequently, regardless of ambient temperature, relay coil 72*c* will be deenergized, the pilot lamps 87 and 88 will be off, and valves 36 and 48 will be in their illustrated positions (assuming that draining has not been initiated manually). If engine 18 stops, NVR contact 83*a* will close, but this will have no effect if ambient air temperature is above freezing. However, under freezing conditions, contact 82*a* also will be closed. Therefore, in this event, engine shut down will immediately cause green lamp 87 to light. When the temperature of the coolant drops to 34° F., contact 77*a* will close, to thereby energize relay coil 72*c* and cause it to close contacts 72*a* and 72*b* and effect energization of solenoid 57. As a result, valve spool 55 will be shifted to its pressurizing position, compressed air will be delivered to working space 43, and motor 41 will open ball valve 36. When motor piston 44 has moved the ball valve to the fully open position, passage 58 will register with port 59, and compressed air will be delivered to the air space in tank 16 via passage 61 and conduit 62. Now, draining of system 13 occurs rapidly by the combined effects of gravity and pressurization. Complete draining should require no more than about 1–1½ minutes. Red pilot lamp 88 will light as soon as solenoid 57 is energized, so the crew is given a visual indication that cooling system 13** has been drained.

The controls normally provided for engine 18 include a low coolant shut-down switch, so the engine cannot be started until cooling system 13 is refilled. This requires closing of ball valve 36, and, regardless of whether ambient temperature is above or below freezing, that step involves two distinct operations. First, manually operated switch 85 is closed to energize time delay relay 84 and effect opening of contact 84*a*. Since contact 84*a* controls the supply of power to both lead 74 and lead 79, relay 72 and solenoid 57 are de-energized as soon as the contact opens. As a result, valve spool 55 shifts to vent position. Second, after the pressure in working space 43 has been dissipated, ball valve 36 may be closed via handle 37. If engine 18 is started before relay 84 times out, contact 83*a* will be open when relay contact 84*a* closes. Therefore, the automatic drain controls will be disarmed and valve 36 will remain closed, even though ambient temperature is below freezing. However, if engine 18 is not started within the holding period of relay 84, then contact 83*a* will be closed when relay contact 84*a* closes. Therefore, in this case, the apparatus will again automatically open valve 36 and drain system 13, assuming that temperature conditions justify that action.

In cases where engine start-up is temporarily delayed or otherwise cannot be completed within the present holding period of time delay relay 84, re-opening of valve 36 by the automatic controls can be delayed by merely again closing switch 85. The resulting momentary energization of coil 84*b* will, in effect, establish a new holding period of the preset duration, and thereby provide the time needed to complete the start-up task.

When battery 73 is connected and air system 51 is charged, cooling system 13 can be drained manually most easily by simply closing switch 86. On the other hand, in cases where battery 73 has been removed, or otherwise disabled, or system 51 is depleted, manual draining can be accomplished by using handle 37 to open valve 36. As in the case of automatic drain action, closure of valve 36 must be effected manually via handle 37, regardless of which procedure was used to accomplish manual draining.

As noted earlier, leads 67 and 74 are connected with battery 73 through contact 83*a* of NVR 83. With this arrangement, manual draining of system 13 cannot be accomplished through use of switch 86 while engine 18 is running. This is considered a desirable feature, even though the engine controls include a low coolant shut-down switch, because it minimizes the risk that a hot engine will be drained too quickly.

Figure 2:
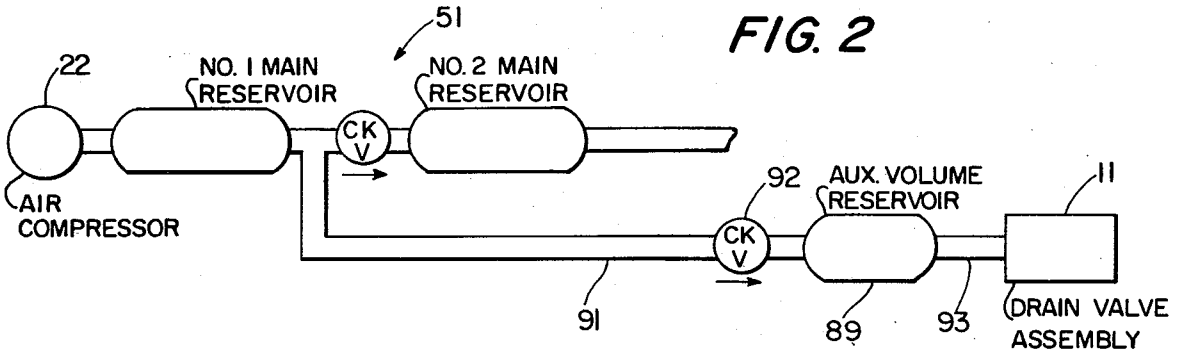
FIG. 2 is a diagram of the preferred air supply circuit of the drain apparatus.

Since, in the FIG. 1 embodiment, compressed air is supplied to assembly 11 directly from locomotive air system 51, the automatic portion of the drain apparatus is rendered inoperative whenever that system is depleted. In view of this, the preferred drain apparatus employs the air supply circuit shown in FIG. 2. This circuit includes an auxiliary volume reservoir 89 which is connected with the No. 1 Main Reservoir of system 51 via a pipe 91 containing a check valve 92, and which, in turn, is connected to supply air to the pilot valve of assembly 11 through a pipe 93. Auxiliary reservoir 89 is charged whenever system 51 is operating, and check valve 92 keeps it in that state as system 51 is depleted. Therefore, the arrangement insures that compressed air will be available for use by the drain apparatus whenever it is needed. The volume of reservoir 89 is, of course, large enough to guarantee that at least one complete pressure assisted draining can be effected. Since the locomotive brake system is supplied from the No. 2 main reservoir, which is charged through a check valve as shown, it will be evident that leakage of air from the drain apparatus will not cause a brake application.

Figure 3:
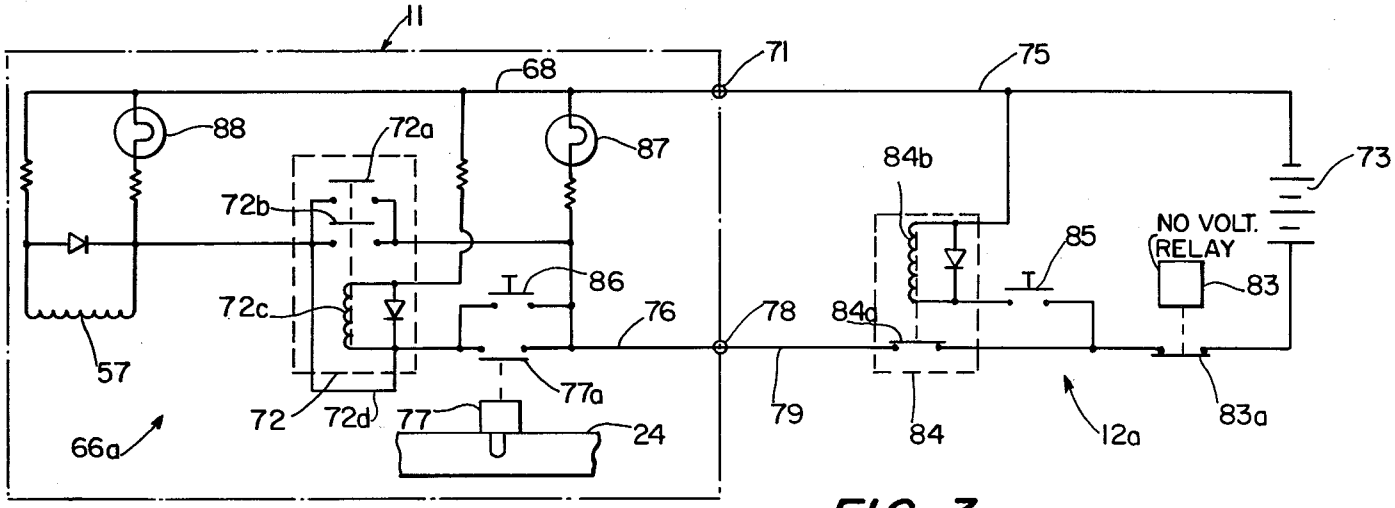
FIG. 3 is a wiring diagram for an alternative control which employs only a coolant temperature sensor.

Although the best form of the invention is thought to be one which incorporates both an air temperature sensor and a coolant temperature sensor, a version which includes only a coolant temperature sensor is almost as good. The apparatus for such an embodiment could be exactly as shown in FIG. 1, except for the elimination of air temperature switch 82 and the substitution of a continuous lead for the switch contact 82*a*. Alternatively, the drain apparatus may utilize the electrical circuit shown in FIG. 3, which requires only two leads 75 and 79 for interconnecting the external and internal circuits 12*a* and 66*a*, respectively. An embodiment which uses only a coolant temperature sensor affords the same protection against freeze-ups as the dual sensor embodiment. However, since the coolant temperature switch 77 in the single sensor version must employ about the same setting as its counterpart in the dual sensor embodiment, in order to insure that none of the coolant in system 13 will freeze, the single sensor version will drain the system when coolant temperature drops to about 34°, regardless of whether or not ambient air temperature is below the freezing point. Thus, the single sensor version will sometimes drain the cooling system when it is not absolutely necessary to do so, and to this extent it is inferior to the dual sensor embodiment.

Figure 4:
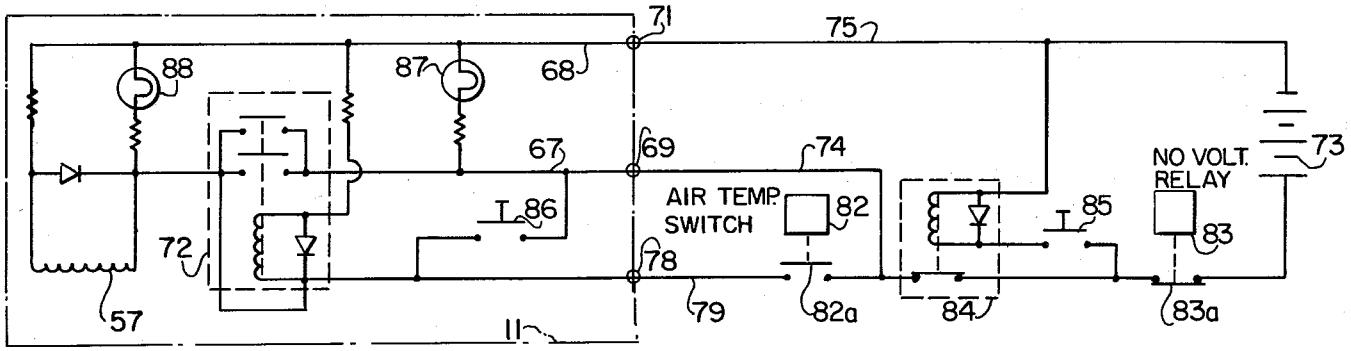
FIG. 4 is a wiring diagram for an alternative control which employs only an ambient air temperature sensor.

It also is possible to employ in the automatic control of the drain apparatus only an ambient air temperature sensor. This version of the invention can use the basic set-up shown in FIG. 1 by simply eliminating coolant temperature switch 77, replacing its contact 77*a* with a continuous lead, and connecting green pilot lamp 87 between leads 67 and 68. This arrangement is shown in FIG. 4. The air temperature sensor in this version of the invention would have to be set at a temperature safely above the freezing point (e.g., 34° F.), rather than at the freezing point as in the dual sensor embodiment, in order to guard against any possibility of freeze-ups. This single sensor version of the invention affords adequate protection against freeze-ups, but can cause unnecessary draining under the same conditions as the embodiments using only a coolant temperature sensor. Moreover, if shut-down of engine 18 should occur while ambient temperature is below freezing, the apparatus may drain the hot engine too quickly.

The inclusion of a green pilot lamp in embodiments having only a single temperature sensor is not as significant as in the case of the dual sensor embodiment, because, in these embodiments, it serves primarily to indicate engine shut-down, a fact which already would be apparent to the crew. However, since the lamp may also be used in testing to verify continuity of at least some of the connections between the internal and external components, it does have some utility in all embodiments.

Figure 5:
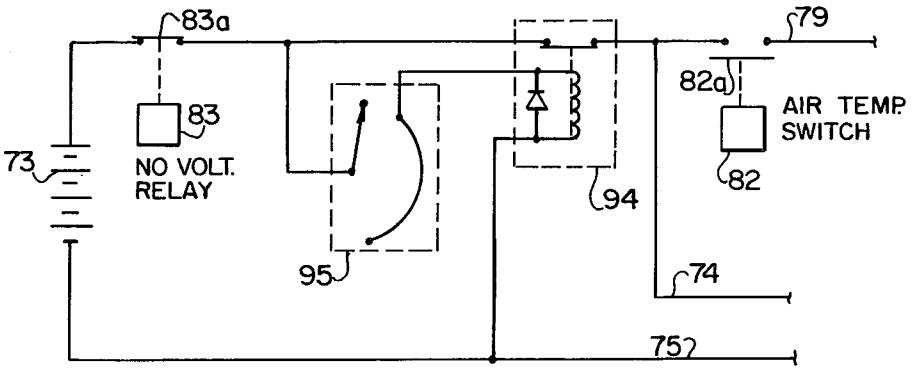
FIG. 5 is a wiring diagram showing the preferred form of the manual reset means.

While the reset mechanism comprising time delay relay 84 and switch 85 has no major disadvantages, the presently preferred reset scheme is the one shown in FIG. 5. This scheme uses a standard relay 94, having no timing capability, which is energized through a circuit containing a commercially available, manually operated, mechanical timing switch 95. This reset mechanism is considered more desirable than the one shown in FIG. 1 because it allows the crewman to select the length of the timing period, provides, via the dial normally furnished with switch 95, an indication of the time remaining to complete filling of system 13 and starting of engine 18, and permits the crewman to terminate reset action whenever this proves necessary or desirable.

I claim:

1. Apparatus for draining coolant from the liquid cooling system of a locomotive engine comprising a. a drain passage connected with the cooling system and containing a rotary, plug type drain valve movable between open and closed positions;

b. motor means effective when energized to move the drain valve to open position but being ineffective to close that valve;

c. automatic control means, including a temperature sensor, for energizing the motor means when the temperature sensed by the sensor reaches a predetermined low value;

d. arming means responsive to the operating state of the engine for enabling the automatic control means to energize the motor means in response to the occurrence of said predetermined low temperature when the engine is not running and for preventing such action of the automatic control means when the engine is running;

e. manually triggered reset means for overriding the automatic control means so as to deenergize the motor means, the reset means including timing means which terminates said override action at the end of a predetermined limited time period following manual triggering of the reset means; and f. manually operable actuating means for moving the drain valve between said positions, but being effective to close that valve only when the motor means is deenergized.

2. Apparatus as defined in claim 1 a. in which the drain passage is connected with the cooling system at the lowest elevation thereof; and b. which includes pressurizing means which is controlled by the automatic control means and which delivers compressed air to the cooling system at an elevation above the liquid level therein, c. whereby draining of coolant from the system is accomplished by the combined effects of gravity and compressed air.

3. Apparatus as defined in claim 2 which includes means for limiting the amount of compressed air delivered to the cooling system by the pressurizing means.

4. Apparatus as defined in claim 2 in which the pressurizing means includes an air supply valve which is operated by the motor means and delivers compressed air to the cooling system only after the motor means has opened the drain valve.

5. Apparatus as defined in claim 2 in which the pressurizing means delivers compressed air to the cooling system through a flow path containing a metering orifice which limits the rate at which compressed air is delivered.

6. Apparatus as defined in claim 5 which includes a check valve located adjacent the cooling system end of said flow path and which is oriented to permit flow toward, but not from, the cooling system.

7. Apparatus as defined in claim 2 in which the pressurizing means includes a. a locomotive compressed air system, including a main reservoir;

b. an auxiliary volume reservoir connected with said air system through a charging passage; and c. a check valve located in the charging passage and oriented to permit flow toward, but not from, the auxiliary volume reservoir.

8. Apparatus as defined in claim 7 in which a. said compressed air system includes a first main reservoir which is charged directly by an air compressor, and a second main reservoir which is charged from the first reservoir through a check valve; and b. said charging passage for the auxiliary volume reservoir is connected with the first main reservoir.

9. Apparatus as defined in claim 1 in which said sensor senses coolant temperature.

10. Apparatus as defined in claim 1 in which said sensor senses ambient air temperature.

11. Apparatus as defined in claim 1 in which a. the automatic control means includes two temperature sensors, one of which senses coolant temperature and the other of which senses ambient air temperature; and b. the automatic control means energizes the motor means only when the temperature sensed by the coolant temperature sensor is below a first predetermined value and the temperature sensed by the air temperature sensor is below a second, lower predetermined value.

12. Apparatus as defined in claim 11 which includes a. two visual indicators which afford different displays, b. one indicator being controlled by the arming means and the ambient air temperature sensor and serving to indicate that the automatic control means is ready to energize the motor means and effect opening of the drain valve when coolant temperature drops to said first predetermined value, and c. the other indicator being controlled by both temperature sensors and the arming means and serving to indicate that the automatic control means has energized the motor means and effected opening of the drain valve.

13. Apparatus as defined in claim 1 which includes a visual indicator controlled by both the arming means and the temperature sensor and which indicates that the automatic control means has energized the motor means and effected opening of the drain valve.

14. Apparatus as defined in claim 13 which includes a second visual indicator which is controlled by the arming means, the second indicator affording a display different from that afforded by the first indicator and indicating that the automatic control means has been enabled by the arming means.

15. Apparatus as defined in claim 1 in which a. the motor means comprises a single-acting fluid pressure motor having a working space and a movable member which responds to the pressure in that space and is connected to move the drain valve toward open position; and b. the automatic control means comprises (1) a source of compressed air, (2) a pilot valve having a control element movable between vent and supply positions in which, respectively, it connects the working space with the atmosphere and the compressed air source, (3) biasing means urging the control element toward vent position, and a solenoid for shifting that element to supply position, and (4) an electrical circuit including the solenoid, a source of electrical energy and switch means controlled by the temperature sensor.

16. Apparatus as defined in claim 15 in which a. said electrical circuit includes a relay having normally open contacts which are connected in a first circuit branch containing the solenoid, and a coil which is connected in a second circuit branch containing said switch means controlled by the temperature sensor;

b. the relay is equipped with a holding circuit; and c. said reset means comprises a normally closed switch through which both of the circuit branches are connected with said source of electrical energy.

17. Apparatus as defined in claim 15 in which the arming means comprises a. arming switch means in said electrical circuit; and b. means responsive to the operating state of the engine and serving to open the arming switch means when the engine is running and to close that switch means when the engine has stopped.

18. Apparatus as defined in claim 17 which includes a. manually operable switch means connected in said electrical circuit in parallel with said switch means controlled by the temperature sensor, b. whereby, when the arming switch means is closed, opening of the drain valve may be effected manually by closure of the manually operable switch means.

19. Apparatus as defined in claim 15 in which the reset means comprises a. a time delay relay including a coil and having a contact in said electrical circuit which normally is closed but which is held open for said limited time period following energization of the relay coil; and b. manually controlled circuit means for momentarily energizing the relay coil.

20. Apparatus as defined in claim 19 in which the manually controlled circuit means comprises the relay coil, the source of electrical energy, and a manually operable switch of the momentarily closed type.

21. Apparatus as defined in claim 15 in which the reset means comprises a. a relay including a coil and having a contact in said electrical circuit which normally is closed but which is open when the relay coil is energized; and b. an energizing circuit for the relay coil connected with the source of electrical energy and containing a mechanical timing switch which may be closed manually and then remains closed for a preselected period of time.

22. Apparatus as defined in claim 15 which includes a. a pressurizing passage which leads from the source of compressed air to a point in the cooling system above the liquid level therein, b. the pressurizing passage passing in series through the pilot valve and through a second valve defined by portions of the fluid pressure motor, c. the arrangement being such that compressed air is delivered to the cooling system to expedite draining after the pilot valve has shifted to supply position and the fluid pressure motor has moved the drain valve to open position.

23. Apparatus as defined in claim 15 in which a. the manually operable actuating means comprises an actuator member coupled directly with the drain valve; and b. the effective area of the fluid pressure motor is correlated with the pressure of the compressed air supplied to the working space so that the drain valve cannot be closed manually via the actuator member as long as the working space is pressurized.

24. Apparatus as defined in claim 23 in which the actuator member is coupled with the drain valve through an easily detachable connection.

25. Apparatus as defined in claim 15 in which a. the automatic control means includes two temperature sensors, one of which senses coolant temperature and the other of which senses ambient air temperature;

b. the temperature sensors control separate switch means connected in series in said electrical circuit; and c. the coolant temperature sensor effects closure of its switch means at a first predetermined temperature, and the air temperature sensor effects closure of its switch means at a second, lower predetermined temperature.

26. Apparatus as defined in claim 25 in which a. the arming means comprises arming switch means in said electrical circuit, and means responsive to the operating state of the engine and serving to open the arming switch means when the engine is running and to close that switch means when the engine has stopped; and b. which includes manually operable switch means connected in said electrical circuit in parallel with the switch means controlled by the temperature sensors, c. whereby, when the arming switch means is closed, opening of the drain valve may be effected manually by closure of the manually operable switch means.

27. Apparatus as defined in claim 26 which includes a. two electrically operated indicators which are connected with the electrical circuit and afford different visual displays, b. one indicator being controlled by closure of the arming switch means and the air temperature switch means and serving to indicate that the automatic control means is ready to energize the solenoid and effect opening of the drain valve when coolant temperature drops to said first predetermined temperature, and c. the other indicator being controlled by closure of the arming switch means and both sensor-operated switch means and serving to indicate that the automatic control means has energized the solenoid and effected opening of the drain valve.

* * * * *